US011619382B2

(12) United States Patent
Witman et al.

(10) Patent No.: US 11,619,382 B2
(45) Date of Patent: Apr. 4, 2023

(54) ADJUSTABLE FUEL ORIFICE

(71) Applicants: Thomas J. Witman, Tipp City, OH (US); Patrick W. Schatz, Tipp City, OH (US)

(72) Inventors: Thomas J. Witman, Tipp City, OH (US); Patrick W. Schatz, Tipp City, OH (US)

(73) Assignee: Hearth Products Controls Co., Kettering, OH (US)

( * ) Notice: Subject to any disclaimer, the term of this patent is extended or adjusted under 35 U.S.C. 154(b) by 264 days.

(21) Appl. No.: 17/181,363

(22) Filed: Feb. 22, 2021

(65) Prior Publication Data

US 2021/0262656 A1 Aug. 26, 2021

Related U.S. Application Data

(60) Provisional application No. 62/979,673, filed on Feb. 21, 2020.

(51) Int. Cl.
*F23D 14/08* (2006.01)
*F23D 17/00* (2006.01)

(52) U.S. Cl.
CPC ..... *F23D 14/08* (2013.01); *F23D 17/00* (2013.01); *F23D 2208/00* (2013.01)

(58) Field of Classification Search
CPC ..... F23D 2208/00; F23D 17/00; F23D 14/08
USPC ..... 431/280, 354
See application file for complete search history.

(56) References Cited

U.S. PATENT DOCUMENTS

| | | | |
|---|---|---|---|
| 7,458,386 | B2 | 12/2008 | Zhang |
| 7,651,330 | B2 | 1/2010 | Albizuri |
| 8,613,276 | B2 | 12/2013 | Parrish |
| 2011/0247607 | A1 | 10/2011 | Streisel et al. |
| 2012/0031397 | A1 | 2/2012 | Streisel et al. |
| 2018/0038592 | A1 | 2/2018 | Willis et al. |

*Primary Examiner* — Vivek K Shirsat
(74) *Attorney, Agent, or Firm* — Thompson Hine LLP

(57) ABSTRACT

A system including a variable orifice component including a main body, a main fuel path extending through the main body, and a control body positioned in the main body. The control body is movable between a first position wherein a first fuel path thereof is in fluid communication with the main fuel path to enable fuel to flow therethrough, and a second position wherein a second fuel path thereof is in fluid communication with the main fuel path to enable fuel to flow therethrough. The system further includes a vent body coupled to the main body. The vent body is movable between a first position wherein the main fuel path is in fluid communication with a vent orifice of the vent body to provide fluid communication between the main fuel path and a surrounding environment, and a second position wherein the main fuel path is not in fluid communication with the vent orifice.

22 Claims, 9 Drawing Sheets

ADJUSTABLE FUEL ORIFICE

This application claims priority to U.S. provisional patent application Ser. No. 62/979,673 filed on Feb. 21, 2020 and entitled ADJUSTABLE FUEL ORIFICE, the entire contents of which are hereby incorporated by reference.

This present application is directed to a fuel orifice, and more particularly, to a fuel orifice which is adjustable for use with different types of fuel.

BACKGROUND

Indoor and outdoor fire effect systems, such as fire pits and fireplaces, require a fuel source, which is typically natural gas ("NG") or liquid propane ("LP"). These different fuels have different optimal combustion conditions, and therefore fuel orifices of differing sizes may be needed to supply the fuel in the desired amount. Furthermore, for certain fuels, a vent or venturi opening may be desired to be used for mixing air with the fuel prior to combustion.

Fuel orifices are typically designed for use with a particular type of fuel to provide a desired BTU output of the associated burner. If, after manufacture, the orifice is installed for use with the wrong type of fuel, the fuel orifice must typically be disassembled and replaced with a proper replacement fuel orifice.

SUMMARY

Accordingly, the fuel orifice of the present disclosure is designed to be adjusted for use with differing types of fuels. More particularly, in one embodiment the invention is a system including a variable orifice component including a main body, a main fuel path extending through the main body, and a control body positioned in the main body. The control body is movable between a first position wherein a first fuel path thereof is in fluid communication with the main fuel path to enable fuel to flow therethrough, and a second position wherein a second fuel path thereof is in fluid communication with the main fuel path to enable fuel to flow therethrough. The system further includes a vent body coupled to the main body. The vent body is movable between a first position wherein the main fuel path is in fluid communication with a vent orifice of the vent body to provide fluid communication between the main fuel path and a surrounding environment, and a second position wherein the main fuel path is not in fluid communication with the vent orifice.

DETAILED DESCRIPTION

Figure 1:
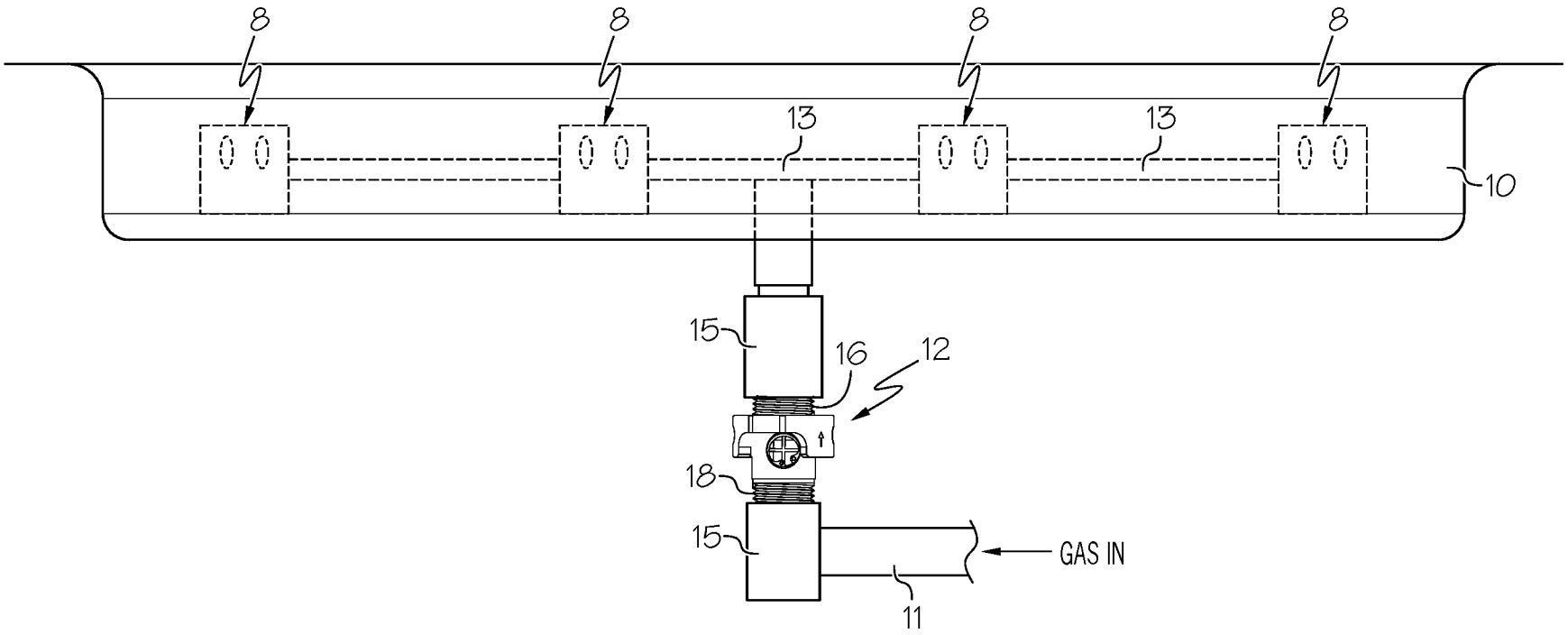
FIG. 1 is a side schematic representation of one embodiment of an adjustable fuel orifice component, shown in conjunction with the fire pan of a fire effect system.

As shown in FIG. 1, a fire system or flame system, such as a fire effect system typically includes a fire pit pan 10 which is configured to support/receive rocks, water, simulated logs or other decorative elements which can cover various burner elements 8 positioned in the fire pit pan 10. The burner elements 8 are fed fuel from a fuel line 11 which delivers fuel to the burner elements 8 via piping or a burner manifold 13 that is fluidly coupled to the fuel line 11. A fuel orifice component 12 is positioned between and fluidly connected to the fuel line 11 and the burner manifold 13 to control or modify the flow of fuel therethrough.

With reference to FIGS. 2-7, the fuel orifice component 12 can include a main body 14 having a pair of opposed, threaded ends 16, 18 which can be threadably coupled the burner manifold 13 (or an adapter 15) and to the fuel line 11 (or an adapter 15), respectively. The main body 14 of the fuel orifice component 12 can be generally cylindrical in shape, and includes a fuel path or main fuel path or fuel delivery path 20 extending axially entirely therethrough from the threaded end 18 (coupled to the fuel line 11) to the threaded end 16 (coupled to the burner manifold 13). The main body 14 can include a pair of generally radially-extending openings/vent openings/venturi openings 24 that provide fluid communication between the fuel delivery path 20 and the outside of the main body 14/ambient environment.

Figure 4:
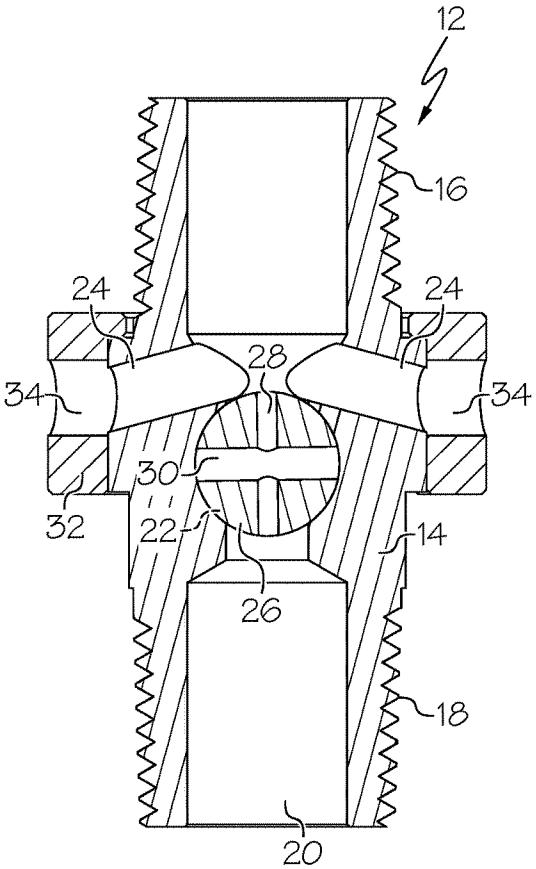
FIG. 4 is a side cross-section taken along line 4-4 of FIG. 2.
Figure 7:
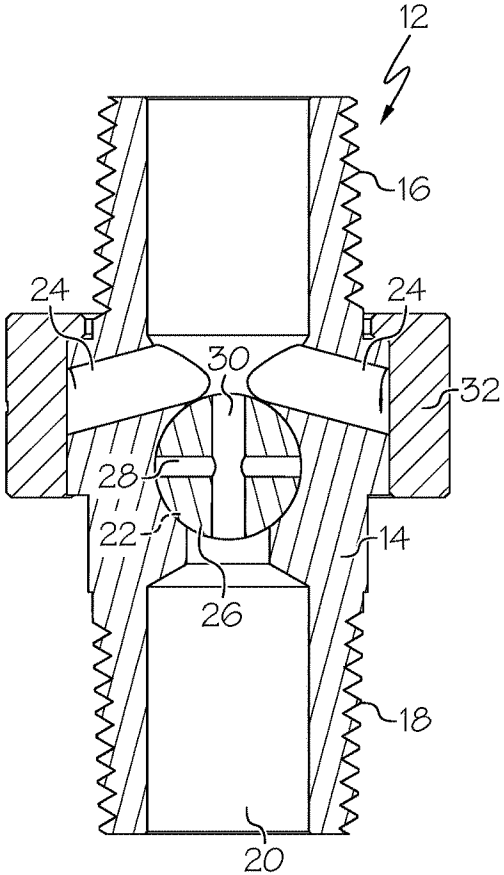
FIG. 7 is a side cross-section taken along line 7-7 of FIG. 5.
Figure 14:
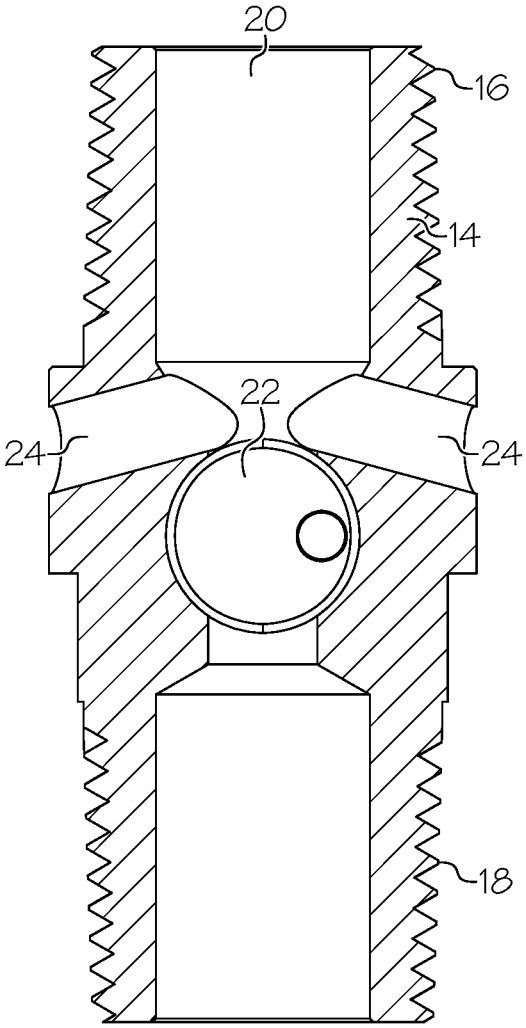
FIG. 14 is a side cross-section of the main body of the fuel orifice component of FIGS. 1-7.

With reference to FIG. 14, the main body 14 can include a generally radially-extending control body opening 22 formed therein, and in fluid communication with the fuel delivery path 20. With reference to FIGS. 4 and 7, a control body 26 can be closely received in the control body opening 22 of the main body 14. With reference to FIGS. 10-13, the control body 26 can be generally cylindrical in one case and include a first fuel path 28 extending entirely therethrough in a generally radial direction (relative to a central axis of the control body 26) and a second fuel path 30 extending entirely therethrough in a radial direction (relative to the central axis of the control body 26). The first 28 and second 30 fuel paths are, in the illustrated embodiment, perpendicular/offset from each other by 90 degrees, and intersect at a common central location. However, if desired the first 28 and second 30 fuel paths may be axially offset such that they do not intersect. In the illustrated embodiment, both fuel paths 28, 30 are generally cylindrical and have a constant diameter. Moreover, in the illustrated embodiment the first fuel path 28 has a smaller diameter/cross-sectional area than the diameter/cross sectional area of second fuel path 30 for reasons which will be discussed in greater detail below.

Figure 8:
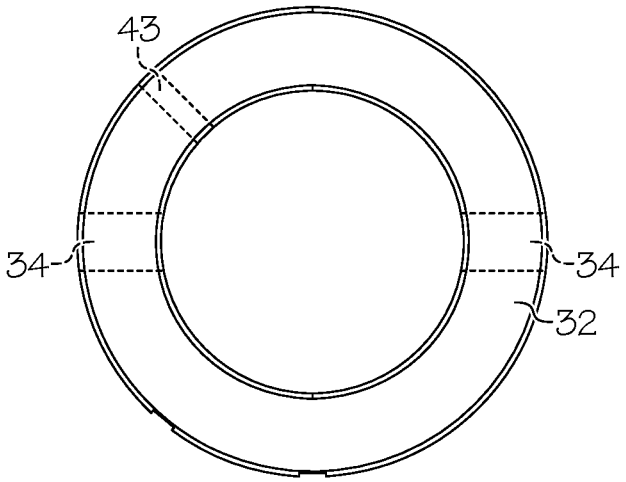
FIG. 8 is a top view of the collar of the fuel orifice component of FIGS. 1-7.
Figure 9:
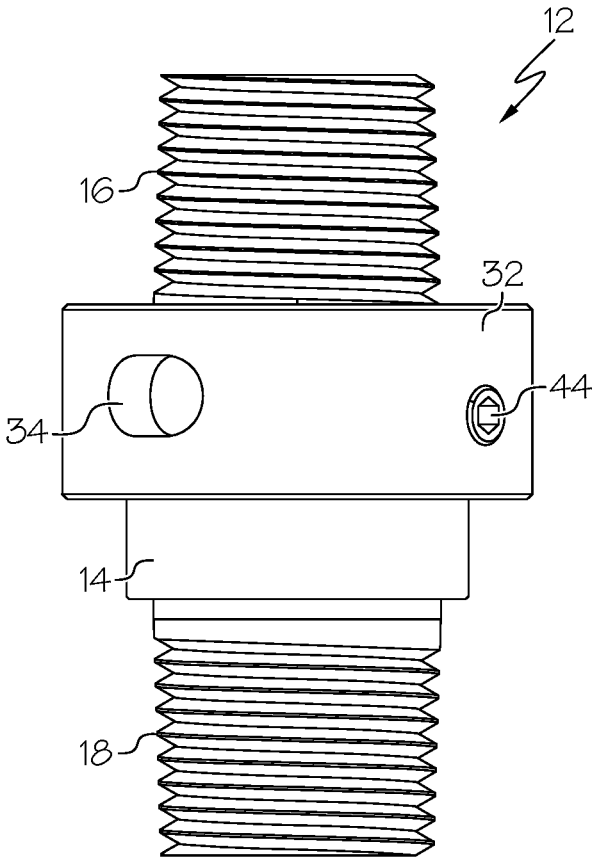
FIG. 9 is a back view of the fuel orifice component of FIGS. 2 and 5.
Figure 10:
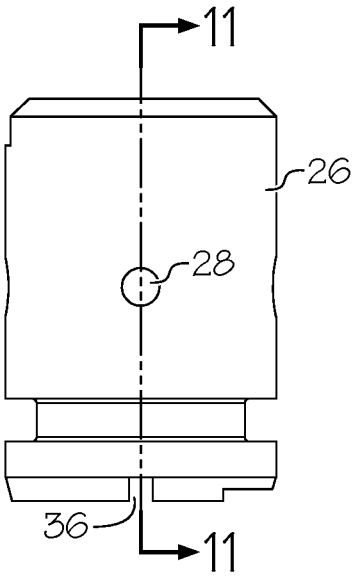
FIG. 10 is a first side view of the control body of the fuel orifice component of FIGS. 1-7.
Figure 11:
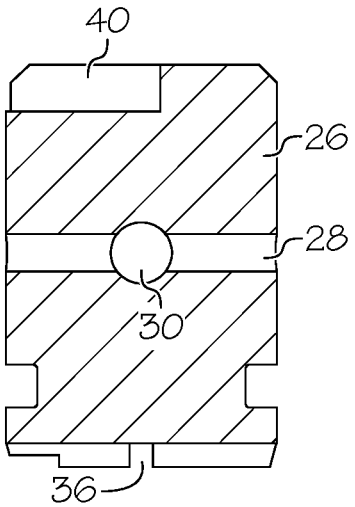
FIG. 11 is a side cross-section taken along line 11-11 of FIG. 10.
Figure 12:
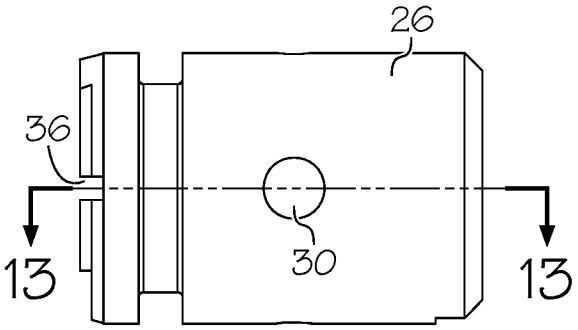
FIG. 12 is another side view of the control body of the fuel orifice component of FIGS. 1-7.
Figure 13:
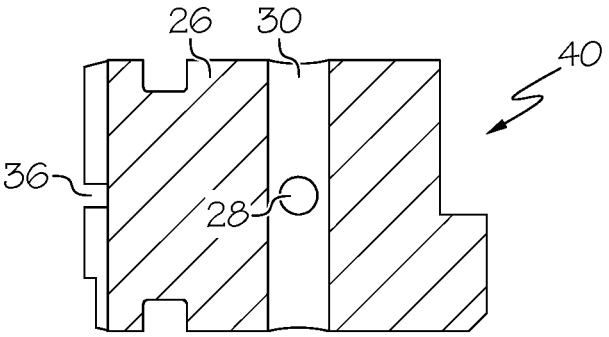
FIG. 13 is a side cross-section taken along line 13-13 of FIG. 12.

With reference to FIG. 8, the fuel orifice component 12 can also include a generally annular collar or venturi component or vent body 32 that includes one or more (a pair in the illustrated embodiment) of opposed generally radially-extending openings/vent openings/venturi openings 34 formed therethrough (see FIG. 4). The vent body 32 is positioned about the main body 14, with the main body 14 therein and being movable relative to the main body 14 to control fluid flow through the venturi openings 24 of the main body 14.

When the fuel orifice component 12 is assembled, the control body 26 is positioned in the control body opening 22 of the main body 14 and mounted in a movable manner such that the control body 26 can be rotated about its central axis, perpendicular to a central axis of the main body 14. The outer face of the control body 26, in the illustrated embodiment, includes a pair of intersecting slots 36 (see FIGS. 3 and 6) formed therein such that a screwdriver with a cross or Philips head can be inserted into the slots 36 to rotate the control body 26 to the desired position. However, the outer face of the control body 26 can include only a single slot (for use with a flathead screwdriver), or have various other shapes formed therein to interact with other tools to enable rotation of the control body. Alternately, the control body 26 may protrude outwardly from the main body 14, and be knurled or roughened to enable the control body 26 to be manually rotated, or have a hexagonal outer shape for use with a wrench, etc. The fuel orifice component 12 can also include a retaining ring 38 (FIGS. 3 and 6) which can be removably fit into the control body opening 22 of the main body 14 (or a groove formed therein) to help retain the control body 26 therein.

The control body 26 is rotatable to a first position (FIGS. 3 and 4) wherein the first fuel path 28 is aligned with, and in fluid communication with, the fuel delivery path 20. In this position, fuel can flow through the main body 14 via the first fuel path 28. In contrast, since the second fuel path 30 of the control body 26 is misaligned with the fuel delivery path 20 and sealed off at its opposed outer ends (in one case via seals 33 as shown in FIG. 17), fluid does not flow through the second fuel path 30 when the control body 26 is in the first position shown in FIGS. 3 and 4.

Figure 6:
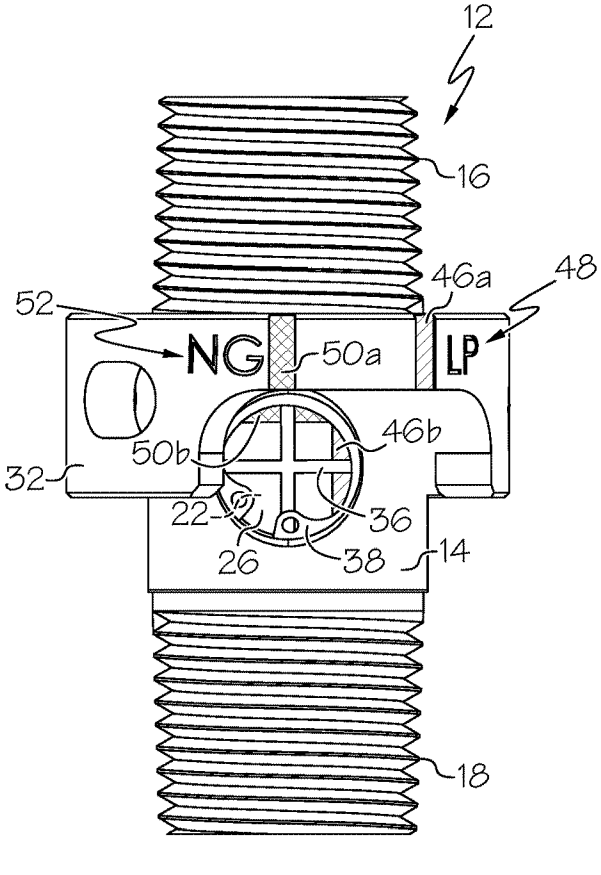
FIG. 6 is a front view of the fuel orifice component of FIG. 5.

The control body 26 is rotatable to the second position shown in FIGS. 6 and 7. When the control body 26 is in the second position the second fuel path 30 is aligned with, and in fluid communication with, the fuel delivery path 20, and the first fuel path 28 is misaligned with the fuel delivery path 20, and its outer ends are sealed such that no fuel can flow through the first fuel path 28. The control body 26 is rotated at least about forty five degrees in one case, or at least about ninety degrees in another case between the first and second positions. The control body 26 can include a notch or cut-out 40 at its distal axial end (see FIGS. 11 and 13) which interacts with corresponding structure in the main body 14 to limit pivoting movement of the control body 26 to ninety degrees between its first and second positions.

Figure 16:
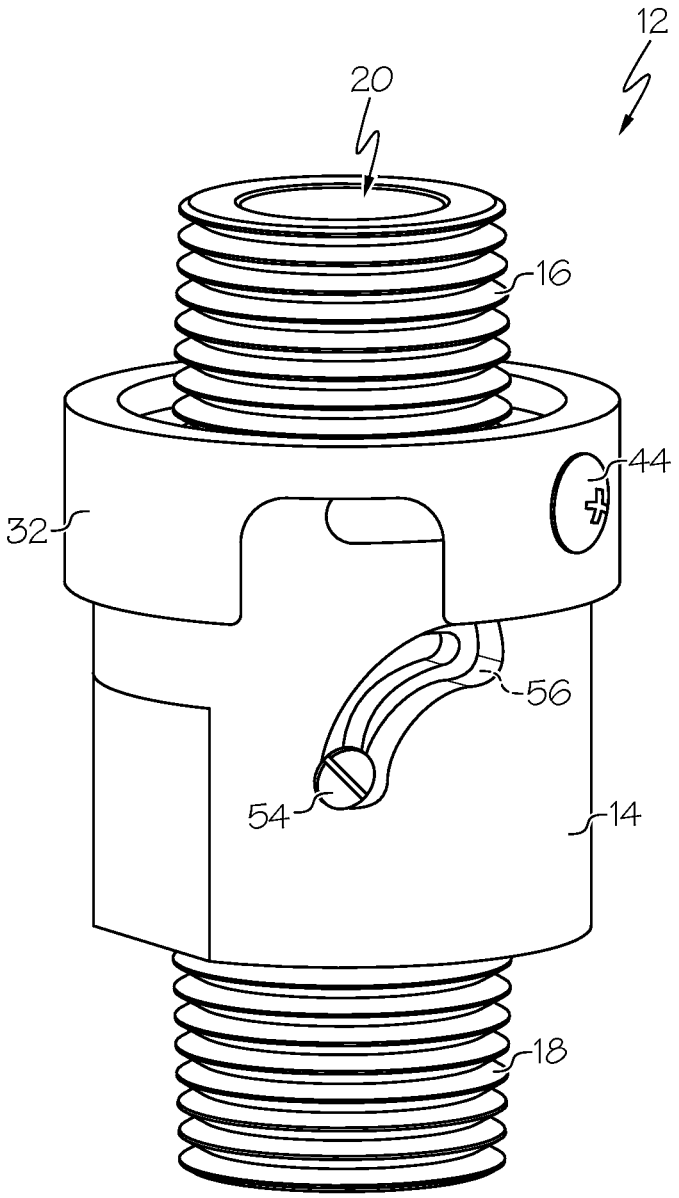
FIG. 16 in an upper perspective view of another embodiment of the fuel orifice component using a retaining screw.
Figure 17:
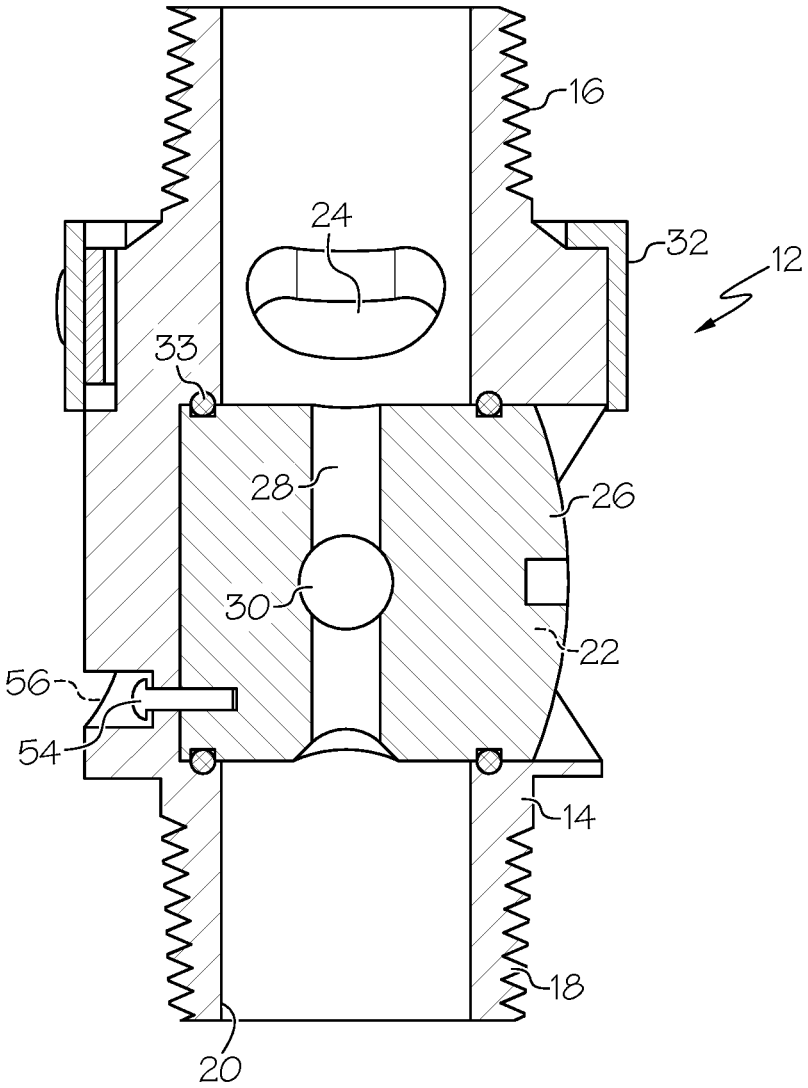
FIG. 17 is a side cross sectional view of the fuel orifice component of FIG. 16.

In one embodiment, as shown in FIGS. 16 and 17, instead of using the retaining ring 38 and/or notch 40, a retaining screw 54 is threaded into the control body 26, and extends through a retaining slot 56 of the body 14. The retaining slot 56 is, in the illustrated embodiment, in an arcuate shape that extends about ninety degrees. In the manner the retaining screw 54 and retaining slot 56 cooperate to retain the control body 26 in place, and also limit rotation of the control body 26 to ninety degrees between its first and second positions. If desired, the retaining screw 54 can be tightened down to secure the control body 26 in the desired position. Moreover, if desired the retaining screw 54 can be replaced with a knurled knob that can be manually operated, or a pin, etc.

Figure 5:
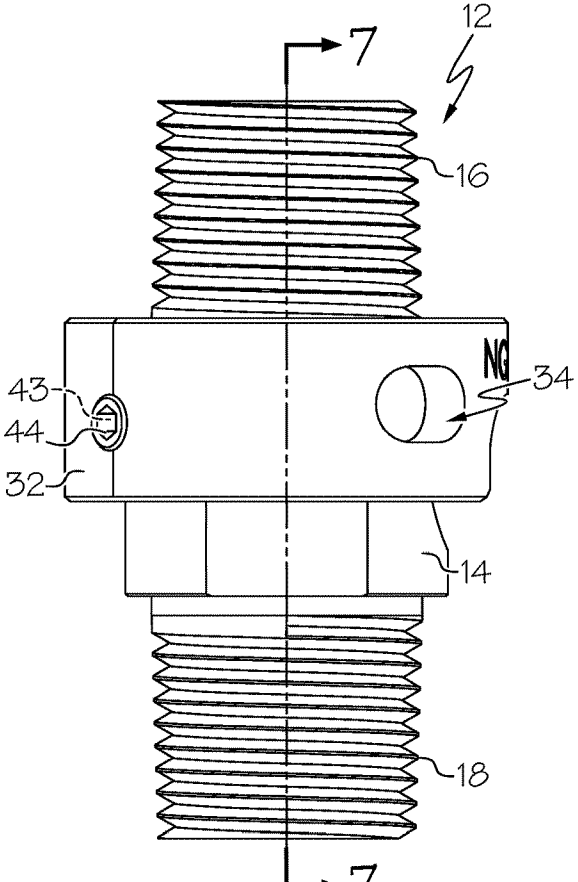
FIG. 5 is a side view of the fuel orifice component of FIG. 1, in a second configuration, configured for use with natural gas.

The collar 32 is rotatably mounted to the main body 14 such that the main body 14 is generally received in the central opening of the collar 32. The collar 32 is rotatable about an axis that is parallel to and aligned with the central axis of the main body 14, and perpendicular to the central axis of the control body 26. The collar 32 is positionable in a first (open) position, shown in FIGS. 3 and 4, wherein the venturi openings 34 of the collar 32 are aligned with, and in fluid communication with, the venturi openings 24 of the main body 14 to thereby provide fluid communication between the ambient atmosphere and the fuel delivery path 20. When in the open position, the collar 32 provides fluid communication between the fuel delivery path 20 and the surrounding environment, such that, for example, oxygen from ambient air can be introduced into the fuel as it flows through the fuel orifice component 12. The collar 32 is also movable to a second (closed) position wherein the venturi openings 34 of the collar 32 are offset from/misaligned with the venturi openings 24 of the main body 14, as shown in FIGS. 5-7. In this case, the venturi openings 24 of the main body 14 are generally closed/fluidly isolated from the surrounding environment by the collar 32.

The collar 32 is rotated about 90 degrees between the open and closed positions in the illustrated embodiment. Thus the collar 32 is rotated at least about forty five degrees in one case, or at least about ninety degrees in another case between the first and second positions. The collar 32 can include a threaded set screw opening 43 extending therethrough through which a set screw 44 is passed and secured to the main body 14, to secure the collar 32 in the desired one of the open or closed positions and/or to limit movement of the collar 32 (e.g. to ninety degrees of travel). However the collar 32 can be secured in place by various other means, such as a radially-protruding, outwardly spring-biased pin that is pressed radially inwardly by a user to release the collar 32, and when the pin is released the pin moves radially outwardly and locks the collar 32 in place. The collar 32 can also include various features that limit the collar 32 to pivoting only between its open and closed positions (e.g. ninety degrees in one case).

The collar 32 may also be positioned in and/or retained in an intermediate position, between the first and second positions. For example, in one case the collar 32 can be rotated forty five degrees (or some other amount) away from the first and/or second positions, which provides some limited air overlap/communication between the venturi opening(s) 34 of the collar 32 and the venturi opening(s) 24 of the main body 14 to thereby provide some fluid communication between the ambient atmosphere and the fuel delivery path 20. In this case the user may be able to control how much air is added to the fuel path 20 by moving the collar 32, and visually monitor the flame during combustion to determine the desired or optimal position for the collar 32. For example in one case the user can visually monitor for when the flame displays desired combustion (such as a blue portion of the flame at its base, which can represent complete combustion of the fuel which reduces soot and combustion byproducts) at various positions of the collar 32.

Thus the collar 32 and control body 26 can be independently and manually controlled and movable between their first and second positions. However, if desired the collar 32 and control body 26 can be linked or operatively connected by a linkage or coupling such that movement of one of the collar 32 or control body 26 to the first position automatically moves the other one of the collar 32 or control body 26 to the first position, and/or movement of one of the collar 32 or control body 26 to the second position automatically moves the other one of the collar 32 or control body 26 to the second position.

Figure 3:
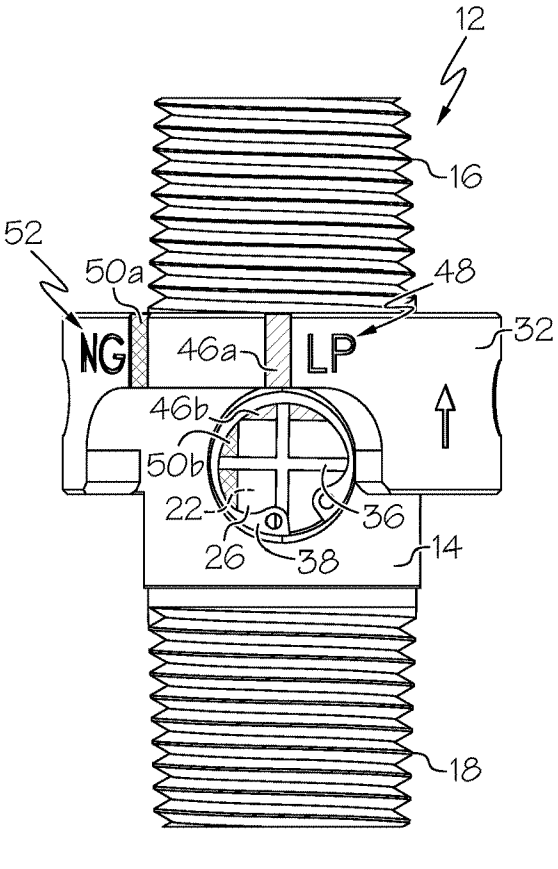
FIG. 3 is a front view of the fuel orifice component of FIG. 2.
Figure 2:
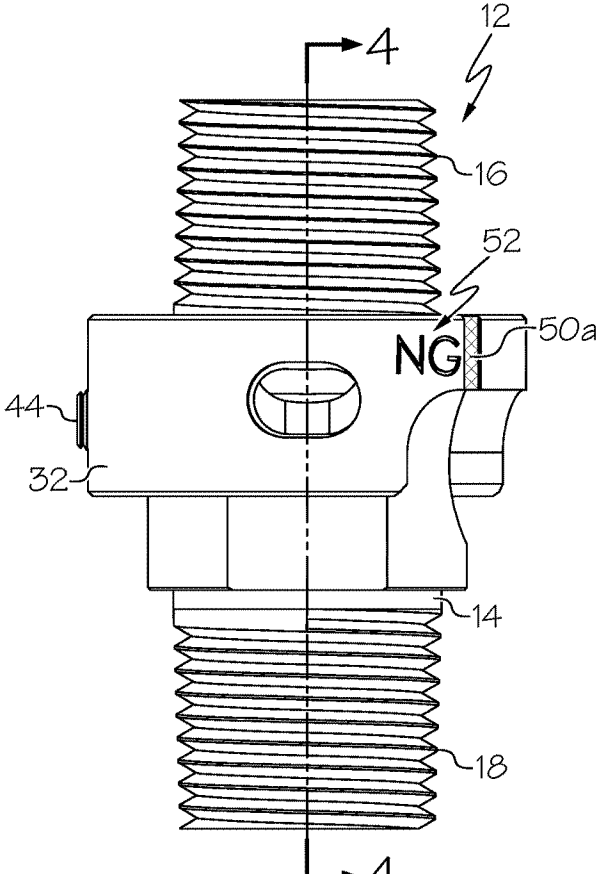
FIG. 2 is a side view of the fuel orifice component of FIG. 1 in a first configuration, configured for use with liquid propane.

As noted above, an orifice for use with a liquid propane may require a smaller orifice opening, along with an open venturi opening or openings 24/34 to ensure proper combustion. Accordingly, as shown in FIGS. 2-4, when the fuel orifice component 12 is in the configuration shown therein, it may be appropriate for use with liquid propane in which the first 28 (smaller) fuel path of the control body 26 limits or meters the flow of fuel therethrough, while the collar 32 is in the open position and allows fluid and air communication through the venturi openings 24/34, such that the orifice component 12 operates as an air mixer and air is introduced in to fluid flowing through the orifice component. The venturi openings 24/34 can be larger than the first fuel path 28. In contrast, FIGS. 5-7 illustrate the orifice component 12 in a second configuration wherein the control body 26 is in its second position to provide a larger orifice, while the venturi openings 24 of the main body 14 are closed/sealed, which may be an appropriate configuration for use with natural gas. In this manner the fuel orifice component 12 can be easily switched between different configurations for use with different types of fuels, without having to disassemble or replace the fuel orifice component 12.

Depending upon the desired fuel flow, the first fuel path 28 and second fuel path 30 can have diameters that vary depending upon the diameter of the inlet fuel line 11, which is pipe diameter is typically either ⅜", ½" or ¾" depending upon the desired BTU output. In one case the first fuel path 28 has a constant diameter (or smallest diameter or orifice at some location along the length therein) ranging from about 0.0635 inches to about 0.228 inches in one case (or to about 0.25 inches in another case), and the second fuel path 30 has a constant diameter (or smallest diameter or orifice at some location along the length therein) ranging between about 0.1015 inches (or about 0.0635 inches in another case) to about ¼" in one case (or to about ⅝" in another case). The fuel orifice component 12 can be used with a variety of combustible fuel, or more specifically in one case any carbon-based or petroleum based fuel, such a (gaseous) natural gas, (liquid) propane, methane or butane, with the orifice size(s) being adjusted as desired to provide the desired combustion properties.

The orifice component 12 can include various indicia, such as color coding, shading, texture, text, symbols, letters, numbers or combinations thereof or the like, to ensure proper configuration and operation of the orifice component 12. In particular, it may be desired to ensure that both the control body 26 and the collar 32 are in their first positions when the orifice component 12 is used with a particular fuel (such as liquid propane), and in their second positions when used with another fuel (such as natural gas). Accordingly, the collar 32 and/or control body 26 can include first indicia **46*a* (such as a color, e.g. red in one case) that is, in one case, positioned adjacent to or otherwise associated with text or other indicia 48 indicating liquid propane, for example the letters "LP" in the illustrated case but could include text "propane," a symbol representing propane, etc. As shown in FIGS. 2-4, the first indicia 46*a* is configured to be axially aligned with the control body 26 (and/or indicia on the control body 26) when the collar 32 is in the first (open) position. Similarly, the control body 26 can include indicia 46*b* (such as the color red in one case, or the letters "LP" or the word "propane," or a symbol representing propane, etc.) that is positioned adjacent to and/or aligned (axially, in one case) with the corresponding indicia 46*a* of the collar 32 when the control body 26 is in the appropriate (first) position. The indicia 46*a*, 46*b* along with the indicating text 48 helps to ensure that the orifice component 12** is in the proper configuration when used with the appropriate fuel, such as liquid propane.

Similarly, with respect to FIGS. 5-7, the collar 32 and/or control body 26 can include second indicia **50*a* positioned with and/or associated with indicia 52 relating to natural gas (in the form of the letters "NG" in the illustrated embodiment, but could include text "natural gas" a symbol representing natural gas, etc.). The second indicia 50*a* is configured to be aligned (axially, in one case) with the control body 26 (and/or the associated indicia) when the collar 32 is in the second (closed) position. The control body 26 can include corresponding second indicia 50*b* that is generally aligned with and/or positioned adjacent to the second indicia 50*a* of the collar 32 when the collar 32 and control body 26** are in the appropriate (second) positions.

The different indicia **46*a*, 46*b* and 50*a*, 50*b* can be positioned within 1" of each other in one case, or within about ½" of each other in another case, when in their appropriate positions indicating the collar 32 and control body 26 are in the associated positions. Alternatively, when the orifice component 12 is in the first position, the indicia 46*b* of the control body 26 may be positioned closer to the indicia 46*a* of the collar 32 than to the indicia 50*a* of the collar 32, and the indicia 46*a* of the collar 32 may be positioned closer to the indicia 46*b* of the control body 26 than to the indicia 50*b* of the control body 26. When the orifice component 12 is in the second position the indicia 50*b* of the control body 26 may be positioned closer to the indicia 50*a* of the collar 32 than to the indicia 46*a* of the collar 32, and the indicia 50*a* of the collar 32 may be positioned closer to the indicia 50*b* of the control body 26 than the indicia 46*b* of the control body 26. Also when the orifice component 12 is in the first position the indicia 46*b* of the control body 26 and the indicia 46*b* of the collar 32 may be positioned closer together than the indicia 50*b* of the control body 26 and the indicia 50*a* of the collar 32. Correspondingly, when the orifice component 12 is in the second position the indicia 50*b* of the control body 26 and the indicia 50*a* of the collar 32 may be positioned closer together than the indicia 46*b* of the control body 26 and the indicia 46*a* of the collar 32**.

Figure 15:
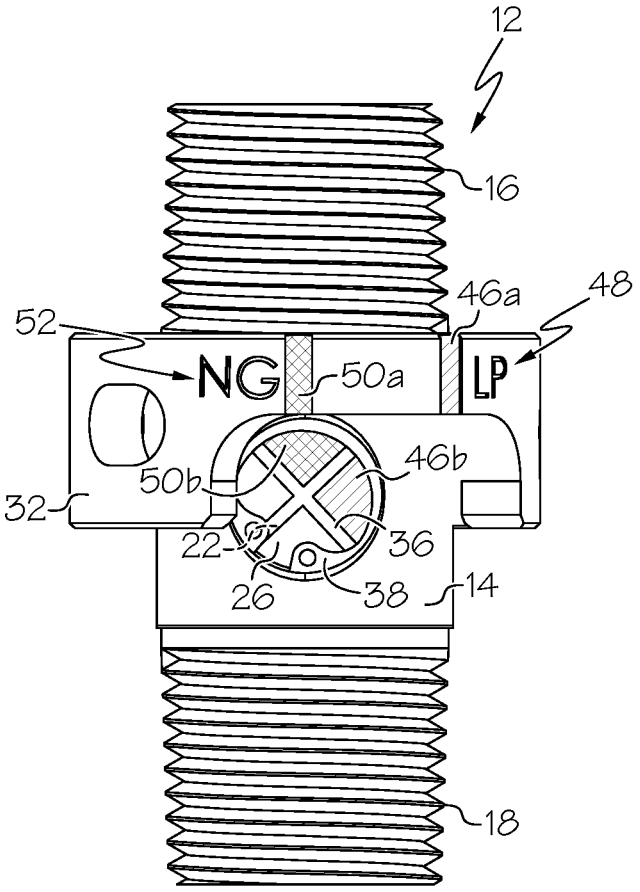
FIG. 15 is a front view of the fuel orifice component of FIG. 5, with an alternate indicia scheme used thereon.

In this manner, the orifice component 12 provides a device, system and method which can be easily adapted for use with different fuels, such as natural gas or liquid propane, or other fuels as desired. The size of the orifice and desired flow conditions (e.g. use of ventilation/venturi openings) can be easily manually adjusted by moving the control body 26 and collar 32 as desired. In addition, various components of the orifice component 12 include color, text and/or other indicia to ensure the orifice component 12 is in the proper operating configuration. The indicia can be arranged at various different positions and in different configurations to convey the message to the user as to whether the control body 26 and collar 32 are in the desired and appropriate configuration. For example, in the embodiment of FIG. 15, the indicia **46*b*, 50*b* on the control body 26 can be positioned to take up an entire quadrant defined between adjacent slots 36, and the control body 26 can be configured such that the slots 36 are at a forty five degree angles when the control body 26** is properly positioned.

Having described the invention in detail and by reference to the various embodiments, it should be understood that modifications and variations thereof are possible without departing from the scope of the claims of the present application.

What is claimed is:

1. A system including a variable orifice component comprising:

a main body;

a main fuel path extending through the main body;

a control body positioned in the main body, wherein the control body is movable between a first position wherein a first fuel path thereof is in fluid communication with the main fuel path to enable fuel to flow therethrough, and a second position wherein a second fuel path thereof is in fluid communication with the main fuel path to enable fuel to flow therethrough; and a vent body coupled to the main body, wherein the vent body is movable between a first position wherein the main fuel path is in fluid communication with a vent orifice of the vent body to provide fluid communication between the main fuel path and a surrounding environment, and a second position wherein the main fuel path is not in fluid communication with the vent orifice.

2. The system of claim 1 wherein the first fuel path has a different cross-sectional area than the second fuel path.

3. The system of claim 1 wherein the first fuel path has a smaller orifice size than the second fuel path.

4. The system of claim 1 wherein the control body is configured such that fuel is generally blocked from flowing through the first fuel path when the control body is in the second position, and such that fuel is generally blocked from flowing through the second fuel path when the control body is in the first position.

5. The system of claim 1 wherein when the control body is configured such that when the control body is in the first position the first fuel path is aligned with the main fuel path and the second fuel path is not aligned with the main fuel path, and such that when the control body is in the second position the second fuel path is aligned with the main fuel path and the first fuel path is not aligned with the main fuel path.

6. The system of claim 1 wherein the control body is rotatable about a central axis thereof and wherein the vent body is a collar that is rotatable about a central axis thereof that is perpendicular to the central axis of the control body.

7. The system of claim 1 wherein the control body and the vent body are both manually and independently movable between their first and second positions.

8. The system of claim 1 wherein the main body includes a vent orifice that is in fluid communication with the main fuel path, and wherein the vent orifice of the vent body is generally aligned with the vent orifice of the main body when the vent body is in the first position, and wherein the vent orifice of the vent body is generally not aligned with the vent orifice of the main body when the vent body is in second first position.

9. The system of claim 1 wherein the vent body is generally annular and receives the main body therein, and wherein the control body is generally cylindrical and is received in a control body opening of the main body.

10. The system of claim 1 wherein the main body is generally cylindrical and the main fuel path extends axially an entire length of the main body.

11. The system of claim 1 wherein the control body includes first indicia thereon indicating when the control body is in the first position, wherein the control body includes second indicia thereon indicating when the control body is in the second position, wherein the vent body includes first indicia thereon indicating when the vent body is in the first position, and wherein the vent body includes second indicia thereon indicating when the vent body is in the second position.

12. The system of claim 11 wherein the first indicia of the control body is configured to be positioned adjacent to the first indicia of the vent body when the control body and the vent body are both in their first positions, and wherein the second indicia of the control body is configured to be positioned adjacent to the second indicia of the vent body when the control body and the vent body are both in their second positions.

13. The system of claim 1 further comprising a burner in fluid communication with the variable orifice component such that the variable orifice component is configured to provide fuel to the burner, and wherein the variable orifice component is configured to provide liquid propane fuel when the control body and the vent body are in their first positions, and wherein the variable orifice component is configured to provide natural gas fuel when the control body and the vent body are in their second positions.

14. A variable orifice component comprising:

a main body;

a main fuel path extending through the main body and configured to allow fuel to flow therethrough;

a control body positioned in main fuel path, wherein the control body has a first fuel path and a second fuel path therein that have different orifice sizes, wherein the control body is movable to enable either the first or the second fuel path to be aligned with the main fuel path to allow fuel to flow therethrough; and a vent body coupled to the main body and having a vent orifice, wherein the vent body is movable between a first position wherein the vent orifice is in fluid communication with the main fuel path to provide fluid communication with a surrounding environment, and a second position wherein the vent body provides no fluid communication between the main fuel path and the surrounding environment or provides a lesser amount of fluid communication between the main fuel path and the surrounding environment as compared to when the vent body is in the first position.

15. A variable orifice component comprising:

a main body;

a main fuel path extending through the main body;

a control body positioned in the main body, wherein the control body is movable between a first position and a second position to thereby present differently-sized orifices to a flow of fuel therethrough; and a vent body coupled to the main body, wherein the vent body is movable between a first position and a second position to control fluid communication of the main fuel path with a surrounding environment, wherein the control body includes first indicia thereon indicating when the control body is in the first position, wherein the control body includes second indicia thereon indicating when the control body is in the second position, wherein the vent body includes first indicia thereon indicating when the vent body is in the first position, and wherein the vent body includes second indicia thereon indicating when the vent body is in the second position.

16. The component of claim 15 wherein the first indicia of the control body is generally aligned with the first indicia of the vent body when the control body and the vent body are in their first positions, and wherein the second indicia of the control body is generally aligned with the second indicia of the vent body when the control body and the vent body are in their second positions.

17. The component of claim 15 wherein the control body is rotatable about an axis oriented generally perpendicular to a central axis of the main body in a direction through which fuel flows, and wherein the vent body is rotatable about an axis oriented generally parallel to the central axis.

18. The component of claim 15 wherein the first indicia of the vent body is axially aligned with the control body when the vent body is in the first position, wherein the second indicia of the vent body is axially aligned with the control body when the vent body is in the second position, wherein the first indicia of the vent body is not axially aligned with the control body when the vent body is in the second position, and wherein the second indicia of the vent body is not axially aligned with the control body when the vent body is in the first position.

19. The component of claim 15 wherein the indicia includes at least one of color, shading, texture, text, symbols, letters or numbers.

20. The component of claim 15 wherein the control body and vent body are configured to be in their first positions when fuel of a first type flows through the component, and wherein the control body and vent body are configured to be in their second positions when fuel of a second type flows through the component, and wherein the component includes indicia relating to the first type of fuel that is associated with first indicia of the control body or the vent body, and wherein the component includes indicia relating to the second type of fuel that is associated with second indicia of the control body or the vent body.

21. The component of claim 20 wherein the first type of fuel is liquid propane and the second type of fuel is natural gas.

22. A variable orifice component comprising:

a main body;

a main fuel path extending through the main body;

a control body positioned in the main body, wherein the control body is movable between a first position and a second position to thereby present differently-sized orifices to a flow of fuel therethrough; and a vent body coupled to the main body, wherein the vent body is movable between a first position and a second position to control fluid communication of the main fuel path with a surrounding environment, wherein the control body includes first indicia and second indicia and wherein the vent body includes first and second indicia, wherein the orifice component is configured such that the first indicia of the control body is positioned adjacent to the first indicia of the vent body when the control body and the vent body are in their first positions, and wherein the orifice component is configured such that the second indicia of the control body is positioned adjacent to the second indicia of the vent body when the control body and the vent body are in their second positions.

* * * * *